US011466506B2

(12) United States Patent
Tulsidas

(10) Patent No.: US 11,466,506 B2
(45) Date of Patent: Oct. 11, 2022

(54) TOUCHLESS SMART STORAGE BOX WITH FACE RECOGNITION

(71) Applicant: Luv Tulsidas, New York, NY (US)

(72) Inventor: Luv Tulsidas, New York, NY (US)

( * ) Notice: Subject to any disclaimer, the term of this patent is extended or adjusted under 35 U.S.C. 154(b) by 404 days.

(21) Appl. No.: 16/676,353

(22) Filed: Nov. 6, 2019

(65) Prior Publication Data

US 2021/0131164 A1 May 6, 2021

(51) Int. Cl.

| | |
|---|---|
| ***E05G 1/10*** | (2006.01) |
| ***G07C 9/00*** | (2020.01) |
| ***G07C 9/37*** | (2020.01) |

(52) U.S. Cl.

CPC ..... *E05G 1/10* (2013.01); *G07C 9/00309* (2013.01); *G07C 9/00912* (2013.01); *G07C 9/37* (2020.01); *E05Y 2400/85* (2013.01)

(58) Field of Classification Search

None

See application file for complete search history.

(56) References Cited

U.S. PATENT DOCUMENTS 10,956,864 B2 * 3/2021 Rahilly ..... B65D 43/26

* cited by examiner

*Primary Examiner* — K. Wong

(74) *Attorney, Agent, or Firm* — Mestechkin Law Group P.C.

(57) ABSTRACT

A touchless smart storage box is presented for storage of valuable items like documents, jewellery, data discs, currency, hand gun, fire arms. the box conducted the authentication based on facial information of the user. Once the facial information matches the contents of the box are visible on the screen by means of an internal baroscopic camera. a hub motor mechanical is used to open and close the door without any physical interaction. Multiple sensors are embedded onto the smart box to indicate its status of open close and location. Due to tempering action the camera gets triggered to capture the scenario and transmit the same to mobile & web application. Communication protocol enables the box to be operated remotely for all interactions.

5 Claims, 5 Drawing Sheets

TOUCHLESS SMART STORAGE BOX WITH FACE RECOGNITION

BACKGROUND & PRIOR ART

Field of Invention

The present disclosure generally relates to safe and secure storage of valuables items like jewellery items, valuable documents, baggage and parcels, locker in financial institutions, medical kits, medicines, etc.

The Safe Box can be used for securing the data storage devices like Hard Disks.

Methods and apparatus for safely storing valuable items are an essential requirement for individuals and companies to protect their valuable assets against man-created and natural perils, i.e., fire, heat, humidity, tampering, theft, and the like.

Traditionally tangible protection is provided by containers (Boxes) made of metallic & polymer materials which are designed with sufficient mechanical, metallurgical, and physical strength and storage volume to serve its intended purpose.

These boxes are equipped with at least one lock having correspondent key to restrict the access to content to authorized users; hence, every time an authorized user needs to gain access to the contents of the box, the user must carry and/use the specified key to open the box and, then, to close the box. In most cases, it is not possible to access, e.g., open or close the box remotely. Even if the box is opened using smart card, the card must be carried physically for every interaction. In currently existing boxes autonomous and hands-free operation is not possible.

Prior art includes numerous safe storage boxes like rectangular box with lid, rectangular sliding draw, a box with side opening door, box with sliding door, box with gravity falling door etc. Majority of designs have a handle to facilitate the operation of closing and opening by one hand or both. Hence remote operation of these boxes is a challenge.

Prior Art includes, safe storage systems which can provide a storage space by means of multiple plates for bottom, top, side, and rear walls. A door is attached to box frame with swing mechanism. Usually the box and user interaction manual i.e. using the one or both the hands for opening and closing. If both the hands are carrying the items to be stored it becomes difficult to access the box. Contents Prior art includes, a design of storage box which with a rigid base plate extending forwardly along with a door mechanism to close and open. The door is hinged at the bottom of the frame, due to this once the lock gets unlocked, the door falls downward due to gravity. This does not require manual effort to open opening the box, but it need human effort for closing & locking. If articles are carried in both the hands it becomes difficult to close the box.

Prior art includes a storage box with a glass window embedded onto one of the side walls of the box. The glass window facilitates the look into the box and to know the presence and absence of the content. This kind of arrangement is not suitable for changing users and content cannot be viewed remotely for the purpose of monitoring and managing multiple storage spaces.

In places like sports facilities, temples, movie theatres, shopping malls multiple people want to access the temporary storage box multiple times during a day, in this scenario there will be significant time consumed leading to unnecessary delay and forming large gatherings of people in usually small spaces where lock-boxes are located. Traditional boxes cannot change the access privileges dynamically to multiple people for that temporary storage of articles to become seamless and hassle free.

Prior art includes, Storage box with barcode, RFD card embedded onto it for the purpose of identification, this cannot be used to locate the box if the box is moved from place of storage to other areas by unauthorized users.

Prior Art includes, safe deposit box with a digital panel, which uses the numeric passcode for authorizing the user. This kind of design have drawbacks of probable mistyping of the digit due to forgetfulness of the user. There is also the probability of cracking the passcode by permutations and combinations by unauthorised users.

In the majority of these boxes the status of open and close position of the door is not known hence cannot be closed or opened remotely.

In view of the obvious shortcomings of the above prior art and overall review of currently available models and methods for safe storage of valuable items, it is evident that there is a need for autonomous safe storage container which can be operated in fully autonomous mode without human touch.

BRIEF SUMMARY OF THE INVENTION

Primary objective of disclosure is to solve some of the drawbacks of current storage boxes by implementing an integrated system comprising (i) a smart storage box, (ii) a face recognition module, (iii) automatic door module, and (iv) web & mobile interface.

Smart Storage Box comprises multiple sensors and communication protocols, for example Wi-Fi, NFC, Bluetooth. GPRS/mobile connectivity through SIM card for remote control and for sending alerts. Smart Box also embedded with a baroscopic camera with LED light.

Face recognition module comprises an edge camera communicatively connected to a processor storing a facial recognition algorithm with features like spoof detection. The face recognition module interacts with cloud database for web and mobile interaction.

Automatic Door Opening module comprises an electric hub motor supported in a circular cylinder for autonomous opening and closing operation of box door. It is to be understood that the automatic door opening model may comprise other mechanisms and elements that are configured to open or/and close the door of the box.

Web & Mobile Module comprises a computer program which, when executed, enables remote operation of a safe box.

BRIEF DESCRIPTION OF DRAWINGS

The subject matter disclosed may best be understood by reference to the following detailed description when read with the accompanying drawings in which.

DETAILED DESCRIPTION OF PREFERRED EMBODIMENT

Figure 1:
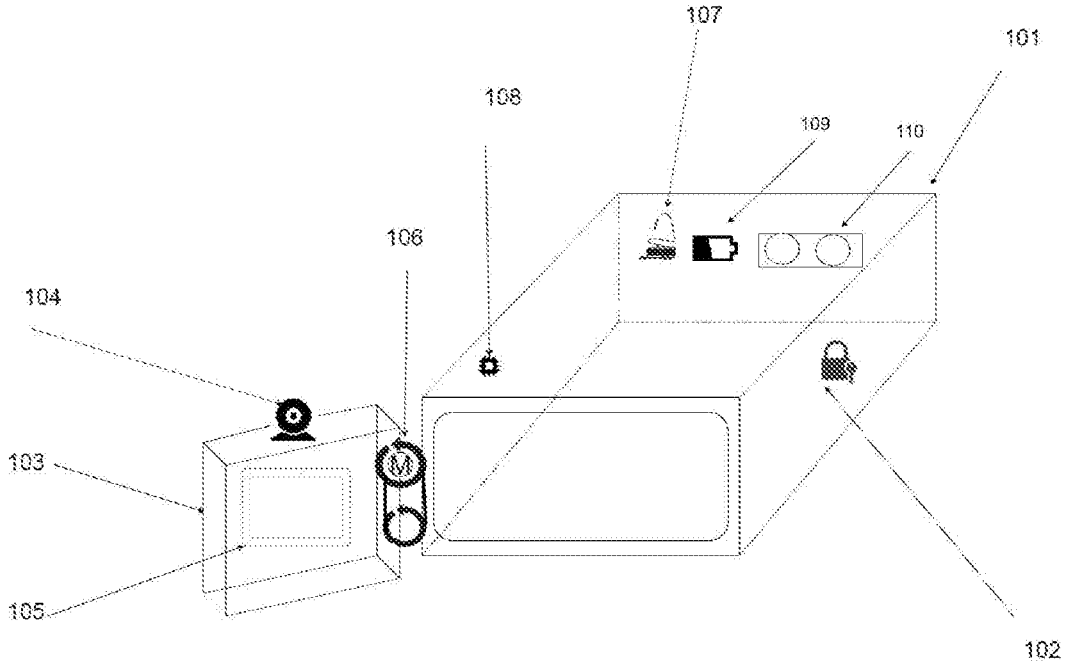
FIG. 1 is a schematic view of Typical configuration of Smart Storage Box according to the preferred embodiment.

The presented invention is directed to a method and apparatus for storing, monitoring, and managing valuable items. As depicted in FIG. 1, the device consists of a container 101 with hollow space for storing articles, a lock 102, a door 103, external camera 104, digital display 105, hub motor 106, internal camera 107, and a processor 108, a plurality of sensors 109, a power source 110

Door 103 is equipped with a lock 102, external camera 104, and a display 105. Door 103 is removably connected to hub motor 106 and to container 101. Lock 102 configured to for the manual mode operation and for remote mode of operation. Each of the plurality of sensors 109 is communicatively connected to at least one indicator being displayed by digital display 105. One of the plurality of sensors 105 is a GPS sensor. One other of the plurality of sensors 105 is a power reserve indicator.

A method of operation of apparatus depicted in FIG. 1 is controlled by a computer program executed by the processor 108. The method of operation comprises the steps of detecting, by external camera 104, proximity of a user to the container 101, capturing, by external camera 104, an image containing facial features of the user, storing the captured facial image of the user in a memory communicatively connected to processor 108, comparing the captured facial image of the user with facial images stored in the memory communicatively connected to processor 108 to determine whether the memory communicatively connected to processor 108 contains a facial image of the user.

If a determination is made that the captured facial image of the user is identical of the stored facial image of the user, an appropriate authentication message is displayed on the digital monitor 105.

If an identify of the user is positively authenticated, the user may execute a command to view the content of the container 101 by invoking functionality of internal camera 107 to capture images of a compartment of container 101. Images captured by internal camera 107 are displayed on digital display 105 for the user to view. It is to be understood that the images captured by internal camera 107 may also be transmitted to a user's other electronic device, e.g., computer, smartphone, and the like.

If the user wishes to access the contents of container 101, the user sends to the system a command to unlock the lock 102 and to open the door 103. Upon detecting the command from the user to unlock the lock 102, processor 108 executes a computer program to send a signal to hub motor 106 to unlock lock 102 and to open the door 103.

Once the user approaches the safe box camera 106 captures the facial features and stores locally in edge processor 108, which further compares the facial image with stored images. Once the user is authenticated the same will be displayed in 105. If the user wants to check the presence and absence of the articles before opening the door a signal triggers the baroscopic internal camera 107. The boroscopic camera which is equipped with LED transmits images of contents to the display device. The same can be viewed from a remote location using a mobile application 503. Once the status is known user can choose to open the door for accessing the articles or can conclude the interaction with the box. After the contents are taken hub motor gets triggered to close the door automatically.

It is to be understood that digital display 105 displays, either continuously or intermittently, indicators corresponding to each of the plurality of sensors 109 and to the status of the power reserve of the power source 110. For example, indicator corresponding to the GPS sensor would be activated upon system's detecting that container 101 has changed its location. An appropriate notification, both visual and audial, is generated by the system and transmitted to the user. One of the notifications is displayed on the digital display 105. Optionally, a second notification is transmitted to the user's other electronic device, e.g., computer, smartphone, and the like.

Similarly, indicator corresponding to the power reserve of the power source 110 sensor is activated upon system's detecting that power reserve of the power source 110 falls below a certain predetermined value. An appropriate notification, both visual and audial, is generated by the system and transmitted to the user. One of the notifications is displayed on the digital display 105. Optionally, a second notification is transmitted to the user's other electronic device, e.g., computer, smartphone, and the like.

Also, indicator corresponding to the sensor responsible for determining whether door 103 is closed and lock 102 in its locked position. A corresponding sensor is activated upon system's detecting that door 103 is ajar or upon detecting that lock 102 in its unlocked position. An appropriate notification, both visual and audial, is generated by the system and transmitted to the user. One of the notifications is displayed on the digital display 105. Optionally, a second notification is transmitted to the user's other electronic device, e.g., computer, smartphone, and the like.

Figure 2:
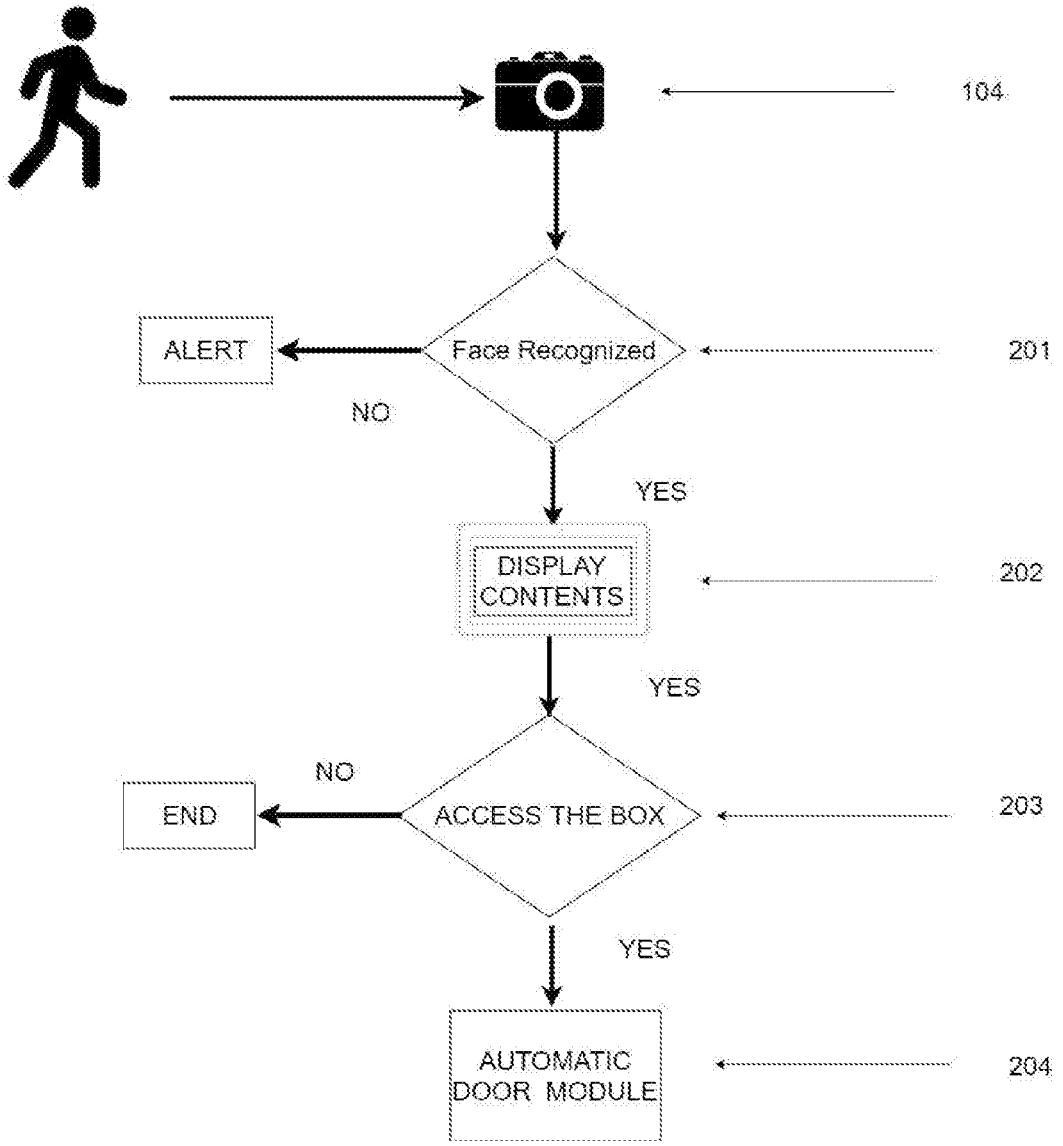
FIG. 2 is a schematic view of flow chart of system operation according to the preferred embodiment.
Figure 3:
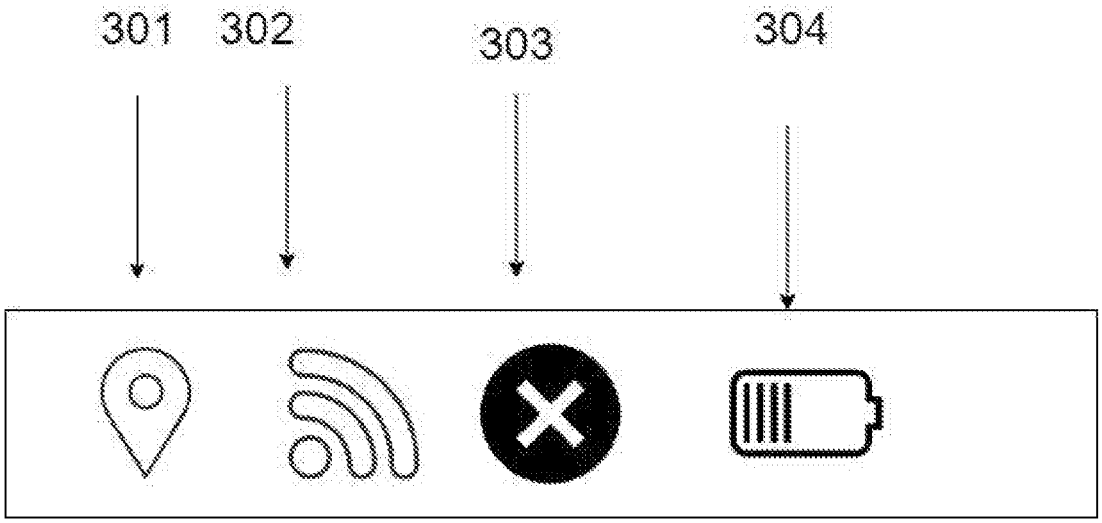
FIG. 3 is a schematic view of Arrangement of sensors according to the preferred embodiment.

FIG. 2 depicts the flow chart of operation of the system with logical interconnection with among various elements.

If the smart box 101 is moved from the defined location to other location GPS sensor 301 will be activated and the location details like longitude and latitude will be shared to mobile application. Sensor 303 is intended to indicate the status of box whether it is open or close, the same information will be displayed on the display 105. Sensor 302 facilitates the internet connection through wi-fi and other protocols. Along with these sensors electric motor will be powered by the battery pack 304.

Figure 4:
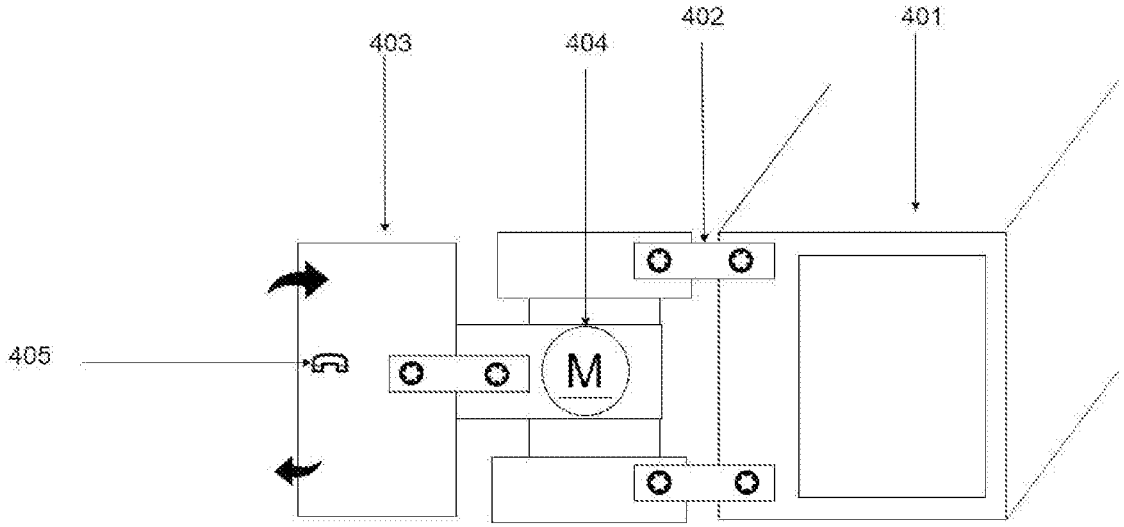
FIG. 4 is a schematic view Working of Automatic Door Opening according to the preferred embodiment.

As depicted in FIG. 4 Whenever a user tries to access the box, facial image will be captured and compared with stored data. Once the face recognition is successful and contents are made visible through display device or mobile application the control will be passed to the automatic door mechanism. The box frame 401 provides space to attach hub motor assembly 404 with set of screws. Central part of motor assembly attached to the door 403 using screw or any other suitable joining means. Once the triggering signal is obtained from edge processor the motor will generate both clockwise and -anti clockwise torque to rotate the door to close & open the door accordingly. Additionally handle 403 is provided for manual mode operation.

Figure 5:
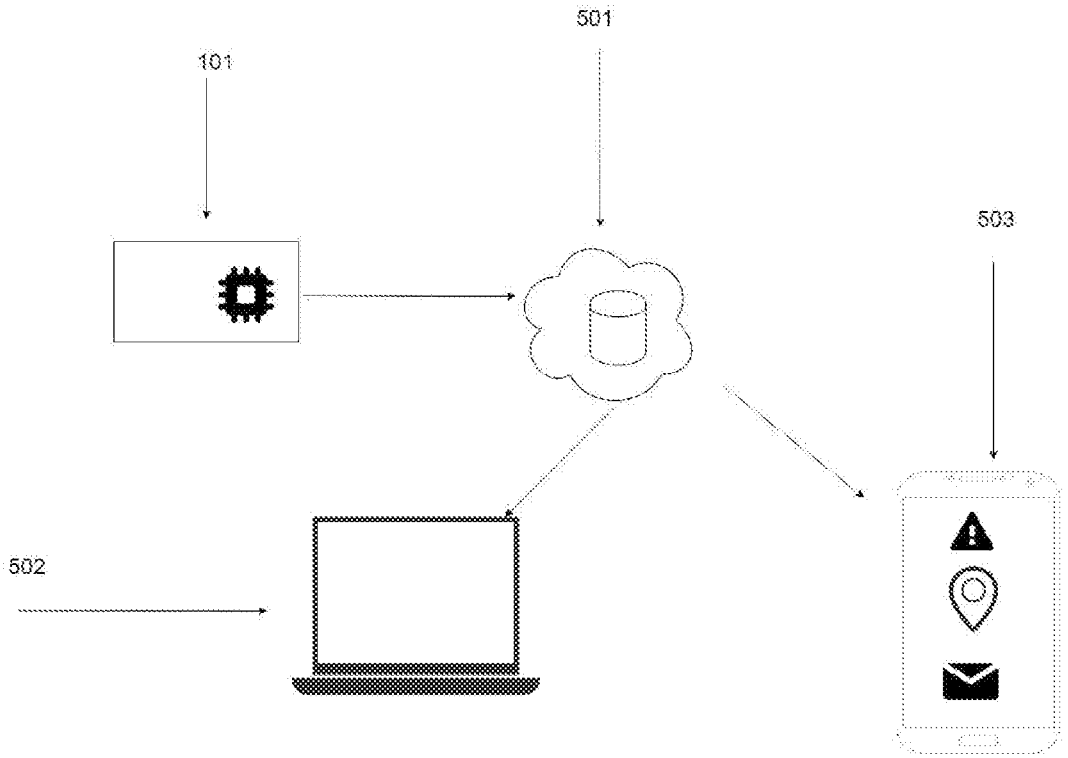
FIG. 5 is a schematic view Web & Mobile Interface according to the preferred embodiment.
Figure 6:
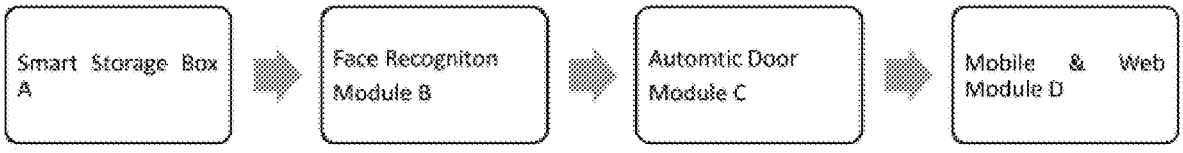
FIG. 6 is a flowchart of a Web & Mobile Module computer program which, when executed, enables remote operation of a safe box.

One of the key aspects of proposed invention is its ability to be operated from remotely through web application and mobile application. As depicted in FIG. 5, cloud database 501 contains the details of authorized users for the box, the same will be assessed by mobile application 503 and web application 502. Mobile application has user interface to indicate the status, location, power level. Mobile application can also alert the user in case of tampering or physical damage. The mobile application shares the image or video information about the tempering scenario. Web & Mobile interface is designed in such a way that the user can perform all the operation without any physical interaction making it fully touchless smart box.

What is claimed is:

1. A touchless smart safe storage box, comprising;

a door for accessing the storage box by selectively opening and closing the storage box;

a touch/non-touch screen display arranged on an outer portion of the storage box, wherein said display is configured for receiving input of a user;

an automatic door mechanism, wherein the mechanism facilitates the door to securely open and close the storage box;

an external camera device, located on said display screen, comprising of a camera adjusting mechanism to intelligently adjust a height and an angle of face of the user while opening or closing the door of the storage box;

a face recognition module that intelligently captures facial image data of the user and transfers said data to a controller for processing, allowing the user to either open and/or close the door of the storage box;

a wireless communication unit for connecting the face recognition module with an authentication device or access control system;

a remote monitoring and accessibility control means, wherein said means generates alerts to the user on a computing device;

an alert system, wherein said system is triggered by a first sensor in the event when the door of the storage box is not closed or locked properly, the smart safe configured for the user to remotely close the smart safe;

a second sensor for detecting a presence of a person in or near the door of the storage box; and a voice authentication module, wherein said module captures audio data through microphone and transfers said data to the controller.

2. The system of claim 1, wherein said external is camera embedded with face recognition algorithm.

3. The storage box according to claim 1, wherein said storage box consists of a lock for selectively locking the door of the storage box and configured for manual mode operation.

4. The storage box according to claim 1, wherein said controller communicates with a computing device to open and close the door of the storage box and perform a series of operations for opening and closing the door of the storage box.

5. A method for opening and closing the safe storage box according to claim 1, the method comprising:

allowing access for opening the storage box to an authorized user through at least one of an external camera device using facial recognition and a voice authentication module;

capturing and processing data of the authorized user by the controller for opening the door of the storage box;

triggering alerts through an alert system, when the door of storage box is not secured properly; and allowing the authorized user to remotely close the door of the storage box through a computing device.

* * * * *